United States Patent [19]

Järmyr et al.

[11] Patent Number: 4,584,929

[45] Date of Patent: Apr. 29, 1986

[54] EXHAUST DEVICE

[75] Inventors: Ragnar Järmyr; Leif Unnerholm, both of Enköping, Sweden

[73] Assignee: AB Bahco Ventilation, Enkoping, Sweden

[21] Appl. No.: 649,770

[22] Filed: Sep. 12, 1984

[30] Foreign Application Priority Data

Sep. 19, 1983 [SE] Sweden ..... 8305034

[51] Int. Cl.[4] ..... F23J 11/00

[52] U.S. Cl. ..... 98/115.1; 126/299 D; 126/299 F; 98/42.06

[58] Field of Search ..... 98/115 R, 115 VM, 115 LH, 98/38 B, 43 B; 126/299 R, 299 C, 299 D, 299 F

[56] References Cited

U.S. PATENT DOCUMENTS

| | | | |
|---|---|---|---|
| 1,391,216 | 9/1921 | Stewart | 98/43 PS |
| 2,526,166 | 10/1950 | Smith | 126/299 F |
| 2,793,712 | 5/1957 | Graswich et al. | 126/299 D |
| 3,221,635 | 12/1965 | Hill, Jr. | 126/299 E |
| 3,364,664 | 1/1968 | Doane | 126/299 D |
| 3,430,551 | 3/1969 | Hauville | 98/115 R |
| 4,134,331 | 1/1969 | Bender | 98/115 LH |
| 4,423,669 | 1/1984 | Bullock et al. | 98/115 R |

FOREIGN PATENT DOCUMENTS

| | | | |
|---|---|---|---|
| 77632 | 6/1981 | Japan | 98/43 B |
| 36789 | 6/1935 | Netherlands | 98/115 R |
| 7611472 | 8/1979 | Sweden . | |
| 7904443 | 8/1981 | Sweden . | |

*Primary Examiner*—Henry C. Yuen

[57] ABSTRACT

An exhaust device comprising an elongate hood having side walls (3,4). An internal, centrally located deflection casing (10) has two mutually aligned suction openings (8,9) which, in combination with an air-supply device (6) disposed at the bottom of the hood, causes the generation of two axially aligned rotational flow patterns (P2, P'2) in the hood between each side wall (4,3) and the central deflection casing (10), from which polluted air is exhausted (via 11,12).

3 Claims, 3 Drawing Figures

EXHAUST DEVICE

The present invention relates to an exhaust device of the kind which comprises an elongate hood, means for generating a rotational flow and at least two air suction openings located on the axis of the rotational flow.

Such devices are described e.g. in SE-C-7611472-7 and SE-B-7904443-4, namely in the form of an elongate hood to be placed over a space or a working area from which particles and/or gases are to be exhausted for safety or comfort reasons. In these known exhaust hoods, an air suction opening and an adjoining exhaust duct is located in one or both of the side walls of the hood so as to create a rotational flow around an axis extending parallelly along the longitudinal direction of the hood through the respective air suction opening. It has turned out that such an air flow provides for an effective capture and exhaust of gaseous and particle impurities, whereas the exhaust flow can be maintained at a relatively low level, which is of course an advantage in respect of energy consumption. In order to enhance the formation of a rotational flow and to further improve the capture of impurities by ejection, a row of ejection openings is preferably arranged at the lower part of the rear wall of the hood, so that the air will form a flat, upwardly directed stream adjacent to the rear wall of the hood, and this flat air stream captures impurities and is transformed into the rotational air flow at the top, whereupon it is exhausted axially through the suction opening in the respective side wall.

However, the disposal of a suction opening in the side wall of the hood involves certain drawbacks, viz.:

- a certain space must be reserved at the outside of the side wall for the exhaust duct connected to the suction opening. Thus, this space cannot be used for other purposes, e.g. for storage cupboards or other equipment; and
- the mounting of the exhaust duct is complicated and costly, particularly if exhaust ducts are connected at both side walls and are drawn to a common junction, which is the case at rather long (wide) hoods.

The object of the invention is to provide an exhaust device of the kind referred to above, which requires less space and is easier to install while maintaining the advantages of an efficient suction and a relatively minor exhaust flow.

As stated in the patent claims, this object is achieved by arranging two mutually aligned air suction openings in an internal deflection casing situated centrally between the side walls of the hood and provided with a central connection opening for connection to an exhaust duct, so that two axially aligned rotational flow patterns are created in the hood between each side wall and the central deflection casing. In this way, installment is substantially facilitated in that the only, centrally located connection opening, which may be directed e.g. upwards or backwards, can be easily connected to one and the same exhaust duct (provided with a suction fan) without the need to install ducts at the side of the hood, e.g. through an adjacent cupboard or other equipment. Therefore, the space beside the hood can be used for other purposes, and the hood may also be placed with the side wall directly contacting an adjacent wall or the like. In comparison with the previously known hoods or a similar kind, provided with only one air suction opening at one of the side walls, the hood according to the invention can be made twice as long (wide), since two axially aligned rotational flow patterns are created.

In order to decrease the pressure drop within the deflection casing, deflection and screening means are preferably arranged in the deflection casing so that the two rotational flow patterns do not disturb each other during the deflection but are individually deflected into a common outwardly flowing, stable air stream. Such means can be constituted by mirror symmetrically bent plates oriented with their convex sides facing each other. An especially advantageous velocity profile of the air flow patterns will be obtained if the plates are bent around an oblique axis, e.g. along a diagonal line at rectangular plates, thereby causing a decreased pressure drop even downstream of the connection opening. Apparently, with such an arrangement, one obtains a well-ordered deflection and transformation of the rotational flow patterns into a common, practically laminar air stream in the connected exhaust duct.

At the bottom, the deflection casing can suitably be designed as a closed box for the collection of separated liquid, e.g. grease, which is preferably drained through a hose or the like to a suitable place. For internal cleaning of the deflection casing it can simply be flushed with water or a cleansing liquid through the respective air suction opening.

The invention will be described more fully below with reference to the appended drawing illustrating a preferred embodiment.

Figure 1:
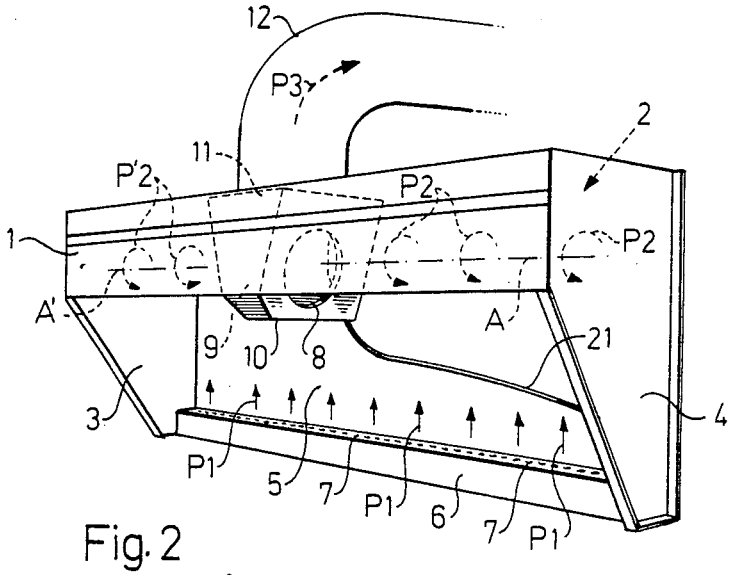
FIG. 1 shows schematically in perspective view an exhaust hood having an internal, central deflection casing according to the invention.

In a known way, the exhaust hood in FIG. 1 comprises a vertical front hood wall 1, which may be at least partly transparent, an upper, horizontal hood wall 2, vertical side walls 3, 4 and a rear vertical hood wall 5, at the lower edge of which there is disposed an air-supply device 6 extending between the side walls 3,4 and providing, via a plurality of small upwardly facing holes 7, an upwardly directed air stream (arrows P1) adjacent to the rear hood wall 5. At the top of the hood, a rotational flow (P2, P'2) is generated by exhausting the air via two suction openings located on an axis A, A' extending in parallel to the longitudinal axis of the hood (and to the air-supply device 6).

According to the invention, these suction openings 8,9 are situated internally in the hood in a deflection casing 10 located centrally between the side walls 3,4 at the underside of the upper, horizontal hood wall 2. The deflection casing 10 has an upper connection opening 11 (not shown in detail), to which an exhaust duct 12 is connected, so that air can be exhausted (arrow P3) by means of a fan (not shown). By the influence of the inlet air P1 from the air-supply device 6 and the underpressure caused by the fan in the two suction openings 8,9, two rotational flows are thus generated, namely a first rotational flow P2 around an axis A between the centre of the air suction opening 8 and the side wall 4, and a second rotational flow P'2 around an axis A' (aligned with the axis A) between the centre of the suction opening 9 and the side wall 3.

Figure 2:
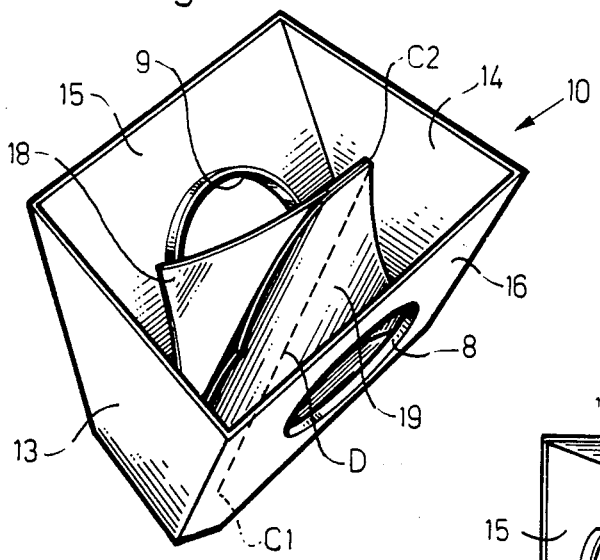
FIG. 2 shows the deflection casing obliquely from above (after being detached from the hood)
Figure 3:
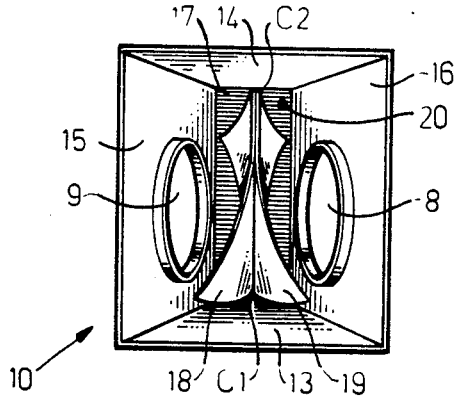
FIG. 3 shows the deflection casing straight from above.

The deflection casing 10 is illustrated in detail in FIGS. 2 and 3, the upper wall thereof with the connection opening 11 being left out. The casing 10 consists of front and rear walls 13 and 14, respectively, two side walls 15,16 being somewhat inclined (inwards-downwards) and having the air suction openings 9 and 8, respectively, and a bottom wall 17 (FIG. 3). For the deflection of each rotational flow P2, P'2 to the common, upper connection opening 11 (FIG. 1), deflection and screening means are disposed centrally in the casing 10, namely in the form of two bent, rectangular plates 18,19. These plates are bent into a part-cylindrical shape around a diagonal line D extending from a lower corner C1 to an upper, opposite corner C2, the plates 18, 19 having their concave sides facing the respective air suction opening 9,8, whereas they contact each other with their convex sides along the diagonal line D. It has turned out that deflection plates thus arranged provide a very good flow with a low pressure drop in the deflection casing 10 as well as downstream of the connection opening 11, which is believed to be the result of the obliquely bent plates 18, 19 being able to deflect and transform each rotational flow P'2, P2 into a common, upwardly directed, stable air-stream without heavy turbulences or pulsations.

Preferably, filters (not shown) can be detachably arranged in each suction opening 8,9 and, furthermore, the bottom wall 17 is provided with a drain opening 20, which is connected to a drain hose 21 (FIG. 1). Liquid, e.g. grease, which is separated when the air flow is deflected in the casing 10 can thus be discharged via the hose 21. However, upon detaching the filters, one can flush with pressurized water or a cleansing liquid via the openings 18, 19, so that remaining impurities on walls and plates are removed.

We claim:

1. An exhaust device comprising an elongated hood defined by front, top, side and rear walls, the rear wall being provided at a lower portion thereof with means to form a generally flat upwardly directed air stream across said rear wall which is transformed into a rotational flow along an axis extending in the longitudinal direction of the hood and within an upper portion thereof, and exhaust means including a deflection casing disposed centrally between said side walls and within said upper portion, said casing being provided with a central opening communicating with an exhaust conduit and oppositely aligned suction openings on the sides thereof, said exhaust openings being disposed at about the axis of rotational flow, whereby said upwardly flowing, generally flat air stream is transformed into two axially aligned, elongated rotational flow patterns, each of which is located between one of said suction openings and a corresponding opposed side wall of the hood, deflection means being centrally disposed within said deflection casing, said deflection means comprising two substantially rectangular plates symmetrically bent in mirror image along mutually parallel diagonal lines extending across each plate and oriented in said casing with their convex sides facing each other.

2. A device according to claim 1, wherein said central opening in said deflection casing communicating with an exhaust conduit faces upwardly and the sides of said casing provided with suction openings are downwardly and inwardly directed in an oblique manner.

3. A device according to claim 1, wherein said deflection casing is provided with a drain opening at the bottom thereof.

* * * * *